US008511985B2

(12) United States Patent
Goβmann

(10) Patent No.: US 8,511,985 B2
(45) Date of Patent: Aug. 20, 2013

(54) DIVIDED TURBOMACHINE HOUSING HAVING OPTIMIZED PARTING LINE FLANGES

(75) Inventor: Otmar Goβmann, Engelskirchen (DE)

(73) Assignee: Siemens Aktiengesellschaft, Munich (DE)

( * ) Notice: Subject to any disclaimer, the term of this patent is extended or adjusted under 35 U.S.C. 154(b) by 539 days.

(21) Appl. No.: 12/919,272

(22) PCT Filed: Jan. 14, 2009

(86) PCT No.: PCT/EP2009/050355

§ 371 (c)(1), (2), (4) Date: Aug. 25, 2010

(87) PCT Pub. No.: WO2009/106377

PCT Pub. Date: Sep. 3, 2009

(65) Prior Publication Data

US 2011/0085904 A1 Apr. 14, 2011

(30) Foreign Application Priority Data

Feb. 27, 2008 (EP) ..... 08003587

(51) Int. Cl.
*F04D 29/64* (2006.01)

(52) U.S. Cl.
USPC ..... 415/214.1

(58) Field of Classification Search
USPC ..... 415/108, 213.1, 214.1
See application file for complete search history.

(56) References Cited

U.S. PATENT DOCUMENTS

| | | | |
|---|---|---|---|
| 2,904,144 | A | 9/1959 | Moore |
| 2006/0269393 | A1 | 11/2006 | Krautzig |

FOREIGN PATENT DOCUMENTS

| | | | | |
|---|---|---|---|---|
| DE | 853 451 | C | | 10/1952 |
| DE | 11 60 701 | B | | 1/1964 |
| EP | 1 707 759 | A2 | | 10/2006 |
| FR | 945 894 | A | | 5/1949 |
| JP | 36021126 | | | 8/1961 |
| JP | 48067521 | A | | 9/1973 |
| JP | 62007903 | A | | 1/1987 |
| JP | 10026006 | A | * | 1/1998 |
| NL | 60 421 | C | | 8/1947 |
| SU | 967 282 | A3 | | 10/1982 |

* cited by examiner

*Primary Examiner* — Richard Edgar

(57) ABSTRACT

A turbomachine housing having a parting line is provided. The turbomachine housing has a first housing part with a first parting line bead, which is implemented on the parting line, a second housing part with a second parting line bead which is implemented on the parting line, and a plurality of parting line clamps. The first parting line bead is enclosed together with the second parting line bead by the parting line clamps, so that the first housing part and the second housing part are held together by the parting line clamps using a positive connection on the parting line beads.

19 Claims, 8 Drawing Sheets

DIVIDED TURBOMACHINE HOUSING HAVING OPTIMIZED PARTING LINE FLANGES

CROSS REFERENCE TO RELATED APPLICATIONS

This application is the U.S. National Stage of International Application No. PCT/EP2009/050355 filed Jan. 14, 2009, and claims the benefit thereof. The International Application claims the benefits of European Application No. 08003587.6 EP filed Feb. 27, 2008. All of the applications are incorporated by reference herein in their entirety.

FIELD OF INVENTION

The invention refers to a turbomachine casing with a parting joint, wherein the turbomachine casing has a small leakage at the parting joint.

BACKGROUND OF INVENTION

A turbomachine, for example a gas turbine, has a casing which for reasons of assemblability of the gas turbine is constructed in a horizontally and/or vertically split manner. The split turbomachine casing for example has a top section and a bottom section which are assembled together, forming a parting joint.

In FIG. 8, the region of the parting joint of a known turbomachine casing 101 is shown in cross section. The turbomachine casing 101 has a top section 102 and a bottom section 103, which together form a parting joint 104. During operation of the turbomachine, the turbomachine casing 101 as a rule is under pressure so that on the inner side 105 of the turbomachine casing 101 a higher gas pressure prevails compared with the outer side 106.

At the parting joint 104, an upper flange 107 is formed on the top section 102, and similarly at the parting joint 104 a lower flange 108 is formed on the bottom section 103, wherein the two flanges 107, 108 form the parting joint 104 by their sides which face each other. Both through the upper flange 107 and through the lower flange 108 provision is made for a flange hole 109 through which a parting-joint stud bolt 110 is inserted. The parting joint stud bolt 110 projects from the upper flange 107 and from the lower flange 108 in each case, wherein the parting joint stud bolt 110 has a threaded portion 111 on its outer sections in each case. Between the threaded portions 111, the parting joint stud bolt 110 is provided with a waisted shank 112. A threaded nut 113, with a washer 114, is screwed on the threaded portions 111 in each case so that by the threaded connection which is thereby created the upper flange 107 and the lower flange 108 are pressed against each other. The force flux which occurs in the top section 102, in the bottom section 103, in the parting joint stud bolt 110, in the threaded nuts 113 and in the washers 114, is shown schematically by arrows 115.

As a result of the threaded connection which is created by the parting-joint stud bolts 110 on the upper flange 107 and on the lower flange 108, the two flanges 107, 108 are fastened to each other in a frictionally engaging manner in the horizontal direction 116.

It is desirable for the parting joint 104 to be as gas leakage-free as possible so that leakage which occurs through the parting joint 104 from the inner side 105 to the outer side 106 during operation of the turbomachine gas is as small as possible.

The reason for the gas leakage is especially the time-delayed and uneven heating-through of the flanges 107, 108 together with the parting joint stud bolt 110, with the threaded nuts 113 and the washers 114 during the non-steady state operation of the turbomachine. The parting joint stud bolt 110 in particular is effected by the delayed heating-up since for construction-related reasons it is generally positioned a long way from the place of heat entry and can only be heated up via small contact surface areas on the threaded portions 111.

Particularly in the casing region which on the inner side is exposed to compressor exit conditions, extremely large temperature differences occur between the upper flange 107 or the lower flange 108 and the waisted shank 112 during cold starting. These temperature differences lead to correspondingly large differences in the thermal expansion of the components in question. As a result of this, a single over-elongation of the parting-joint stud bolt 110 occurs during the very first start-up of the turbomachine, which results in a permanent reduction of the pretension of the parting-joint stud bolt 110 and therefore in a reduction of the surface area pressure at the parting joint 104. In addition, the upper flange 107 and the lower flange 108 deform in relation to each other on account of their inhomogenous heating-through, which in combination with the reduced pretension of the parting-joint stud bolt 110 leads to a gap at the parting joint 104. As a result, a gas leakage occurs at the parting joint 104.

The gas leakage is particularly large in the region of the turbomachine casing 101 at which a plurality of parting joints 104 intersect. In the region of intersection, on account of the provision of upper flanges 107 and lower flanges 108 for each parting joint 104, the wall thickness of the turbomachine casing 101 is particularly large so that during start-up of the turbomachine large temperature differences can occur in its material in the region of intersection. It should be added that owing to the geometrically confined conditions optimum threaded-joint tightness of the parting-joint stud bolts 110 cannot be provided on account of collisions of threaded-joints. Therefore, the region of intersection is characterized by particularly high rates of gas leakage.

The development of modern gas turbines is particularly to the effect that the compression ratio is to be increased significantly by 1.5 to 2 compared with today's customary factors. The even higher flange forces which result from this, and also the even higher compressor exit temperatures, would have the result that higher gas leakage rates would need to be reckoned with in modern turbomachine casings with the conventional construction at the parting joint 104 with the upper flange 107, the lower flange 108 and the parting-joint stud bolt 110. Moreover, the upper flange 107 and the lower flange 108 would have to be dimensioned larger and would have to be produced from a higher-grade material in order to cope with the anticipated higher compressor exit temperature and the increased pressure. Both measures lead to a cost increase and to a deterioration of the boundary conditions for the conventional flange construction since an even longer heat transporting path and an even more uneven heating-up resulting therefrom together would be associated with even greater loss of pretension of the parting-joint stud bolt.

In addition, in the region of the parting joint 104 the turbomachine casing 101 has the force flux 115 which is asymmetrical. Consequently, during cold starting the parting-joint stud bolt 110, in addition to pure tensile forces, also experiences a bending stress, which intensifies the uneven thermal expansion in the region of the parting joint 104. In order to take into account the bending stress of the parting joint stud bolt 110, a correspondingly stable design of the threaded joint and a correspondingly thick construction of the upper flange 107 and of the lower flange 108 are to be provided. This, however, would result in a further deterioration of the uneven temperature distribution in the region of the parting joint.

Furthermore, a casing for a turbomachine with two abutting casing shells is known for example from EP 1 707 759 A2. In order to avoid asymmetrical deformation of the casing during operation of the machine, a form-fitting connection by means of a bridge, which clamps the two shells together, is provided on the outer side of the casing.

Furthermore, a connection of casing sections of a high-pressure vessel is disclosed in laid-out specification DE 1 160 701, which in addition to a customary external bolted flange joint has a clamping arrangement with wedge taper on the inner side of the casing.

SUMMARY OF INVENTION

It is an object of the invention to create a turbomachine casing with a parting joint, wherein the turbomachine casing has a slight gas leakage at the parting joint.

The turbomachine casing according to the invention with a parting joint has a first casing section with a first parting-joint protuberance which is formed at the parting joint, a second casing section with a second parting-point protuberance which is formed at the parting joint, and a plurality of parting joint clamps, wherein the first parting-joint protuberance together with the second parting-joint protuberance are encompassed by the parting joint clamps so that the first and the second casing sections are held together by the parting joint clamps by means of a form-fitting connection on the parting joint protuberances.

In the parting joint region, which is symmetrically constructed according to the invention, of the turbomachine casing, provision of large wall thicknesses in the parting joint region is eliminated. As a result, the wall thickness distribution of the turbomachine casing is more even, as a result of which a transient heating-up of the turbomachine casing, especially during start-up of the turbomachine, takes place more evenly and more quickly. Consequently, only weak temperature gradients occur in the material of the turbomachine casing, which in particular result in no distortion, or a slight distortion, in the parting joint region of the turbomachine casing. Since large distortions could lead to gas leakage of the turbomachine casing, the effect of the turbomachine casing having a low leakage rate in the parting joint region is achieved according to the invention. Moreover, the turbomachine casing according to the invention has a low weight, as a result of which low material costs are incurred during production. Moreover, the turbomachine can be operated with fast start-up gradients without leakages occurring on the turbomachine casing according to the invention in the parting joint region.

It is preferred that each parting joint protuberance extends both on the inside and on the outside of the turbomachine casing and that each parting-joint clamp has an inner part and an outer part, wherein the inner part acts upon the inner sections of the parting-joint protuberances and the outer part acts upon the outer sections of the parting-joint protuberances. As a result, the effect of the force flux extending symmetrically in the wall of the turbomachine casing in the region of the parting joint is achieved according to the invention in a construction-related manner. Therefore, the effect of the parting joint protuberances experiencing a bending stress and the parting joint clamps being subjected to only slight bending stresses, is prevented.

In addition, it is preferred that the parting-joint clamp has a single inner part and a single outer part, or a single inner part and a multiplicity of outer parts, or a multiplicity of inner parts and a single outer part.

As a result, depending upon the pressure ratios inside the turbomachine casing, a dividing of the parting-joint clamps into inner, parts and outer parts can be correspondingly undertaken so that the use of the parting-joint clamps is optimized and therefore the production costs of the turbomachine casing are minimized.

Moreover, it is preferred that at each position of the parting joint, at which one of the parting-joint clamps is arranged, the turbomachine casing has at least one parting-joint hole and the parting-joint clamp has at least one retaining means which extends through the parting-joint hole and is fastened both to the inner part and to the outer part so that by the retaining means the inner part and the outer part are held against the parting joint protuberances and interact with them in a form-fitting manner in such a way that the casing sections are pressed together at the parting joint by the parting-joint clamps.

It is also preferred that on the inner and on the outer sections of the parting-joint protuberances provision is made for a protuberance flank in each case, and also that the inner part has clamp flanks which interact with the inner protuberance flanks and the outer part has clamp flanks which interact with the outer protuberance flanks, wherein the protuberance flanks and the clamp flanks are arranged in an inclined manner in such a way that when the inner part and the outer part are held together by the retaining means the parting joint protuberances are pressed together by the parting-joint clamps. The retaining means preferably has a retaining screw which is arranged in a manner in which it is inserted through the parting joint hole and with the inner part and the outer part forms a threaded connection in each case.

Consequently, with the retaining screw the inner part is advantageously pressed against the turbomachine casing from the inside and the outer part is pressed against the turbomachine casing from the outside, wherein the inner part with its clamp flanks is pressed against the protuberance flanks of the inner sections of the parting-joint protuberances and the outer part with its clamp flanks is pressed against the protuberance flanks of the outer sections of the parting-joint protuberances. On the respectively abutting flanks, the inner part and the outer part can slide to and fro on the parting-joint protuberances so that during tightening down of the retaining screw both the inner part and the outer part are wedged against the parting joint protuberances in such a way that the casing sections, which are clamped to each other, are pressed flat against each other at the parting joint.

The retaining means preferably has a threaded nut, wherein the retaining screw is screwed into a threaded hole of the inner part and is inserted through an insertion hole of the outer part, and also is tightened up by means of the threaded nut from outside the turbomachine casing.

As a result, the threaded nut is easily accessible from outside the turbomachine casing, wherein the installation of the parting-joint clamps can be carried out in a simple and quick manner.

In addition, it is preferred that a washer is arranged between the threaded nut and the outer part. Subsequently, it is preferred that the tightening down force of the threaded nuts is distributed evenly to the outer part.

Moreover, it is preferred that between the inner part and the inner sections of the parting-joint protuberances, provision is made for a seal so that the inside of the turbomachine casing is outwardly sealed.

As a result, the turbomachine casing having a leakage at the parting joint is also prevented.

The parting joint is preferably a horizontal parting joint and the parting-joint clamp is preferably designed to hold together the horizontal parting joint.

Alternatively, the parting joint is preferably a vertical parting joint and the parting joint clamp is preferably designed to hold together the vertical parting joint.

Moreover, it is preferred that the horizontal parting joint and the vertical parting joint intersect and that at the point of intersection provision is made for an intersection parting joint clamp which is formed in one piece from two parting-joint clamps which are provided for the horizontal parting joint and are arranged in an oppositely disposed manner on the inside and on the outside at the point of intersection, and from two parting joint clamps which are provided for the vertical parting joint and are arranged in an oppositely disposed manner at the point of intersection.

Consequently, the effect of the vertical parting joint and the horizontal parting joint being held together in an effective and sealed manner at the point of intersection by the intersection parting joint clamps is advantageously achieved. In addition, in particular the wall thicknesses of the turbomachine casing in the region of the point of intersection are not constructed excessively thick so that the turbomachine casing can be quickly heated through especially in the region of the point of intersection. In addition, on account of the construction according to the invention of the intersection parting-joint clamps in the region of the point of intersection, no collisions of threaded joints occur.

In principle, it is advantageously possible for a turbomachine casing to be provided, for example, with a conventional parting joint connection at the horizontal parting joint and at the vertical parting joint, wherein provision is made for the intersection parting-joint clamps according to the invention in the region of the point of intersection. As a result, both the conventional parting-joint connection and the intersection parting joint clamps according to the invention can be used on the turbomachine casing.

BRIEF DESCRIPTION OF THE DRAWINGS

A preferred exemplary embodiment of the turbomachine casing according to the invention is explained in the following text with reference to attached schematic drawings. In the drawing.

DETAILED DESCRIPTION OF INVENTION

Figure 1:
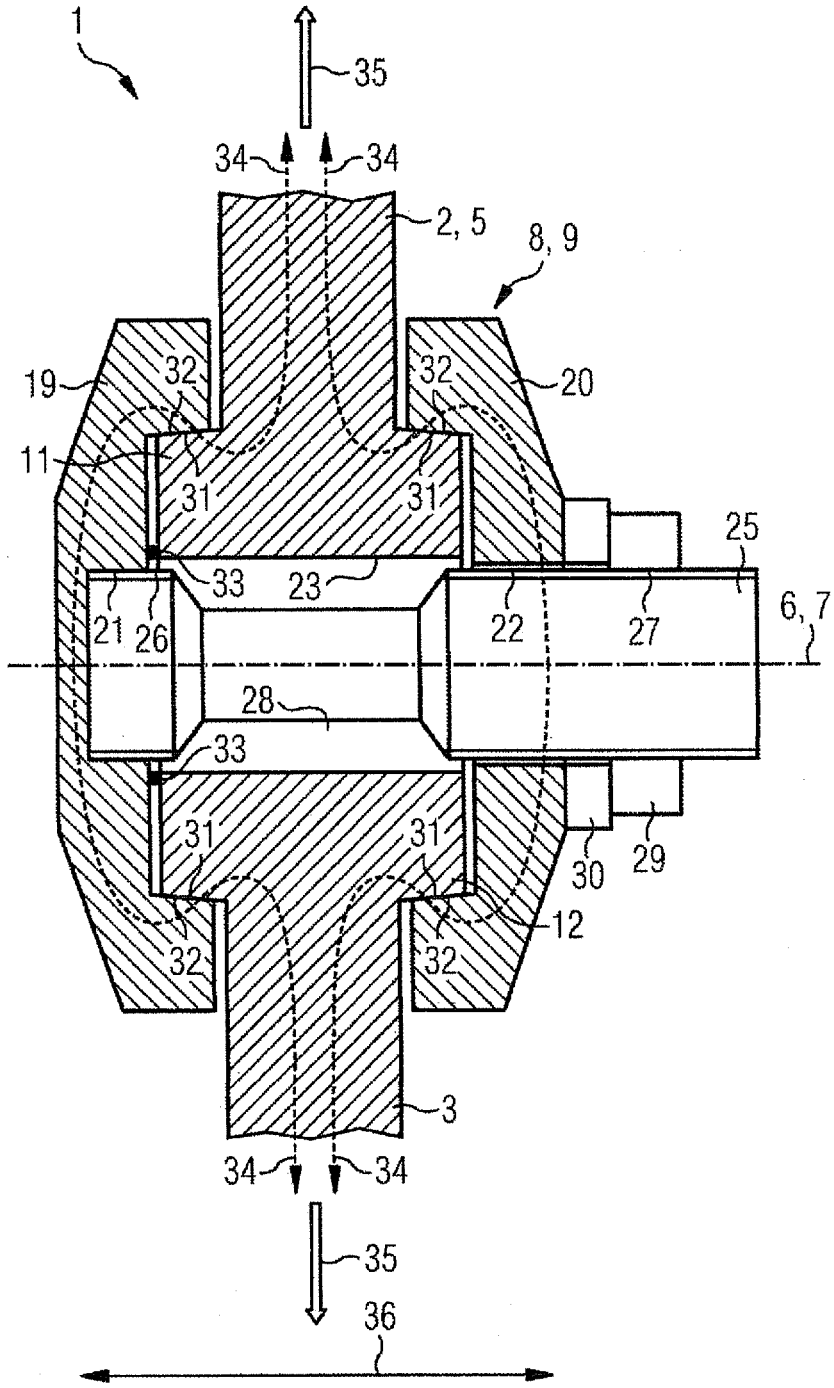
FIG. 1 shows a cross section through a turbomachine casing in the region of a parting joint.
Figure 2:
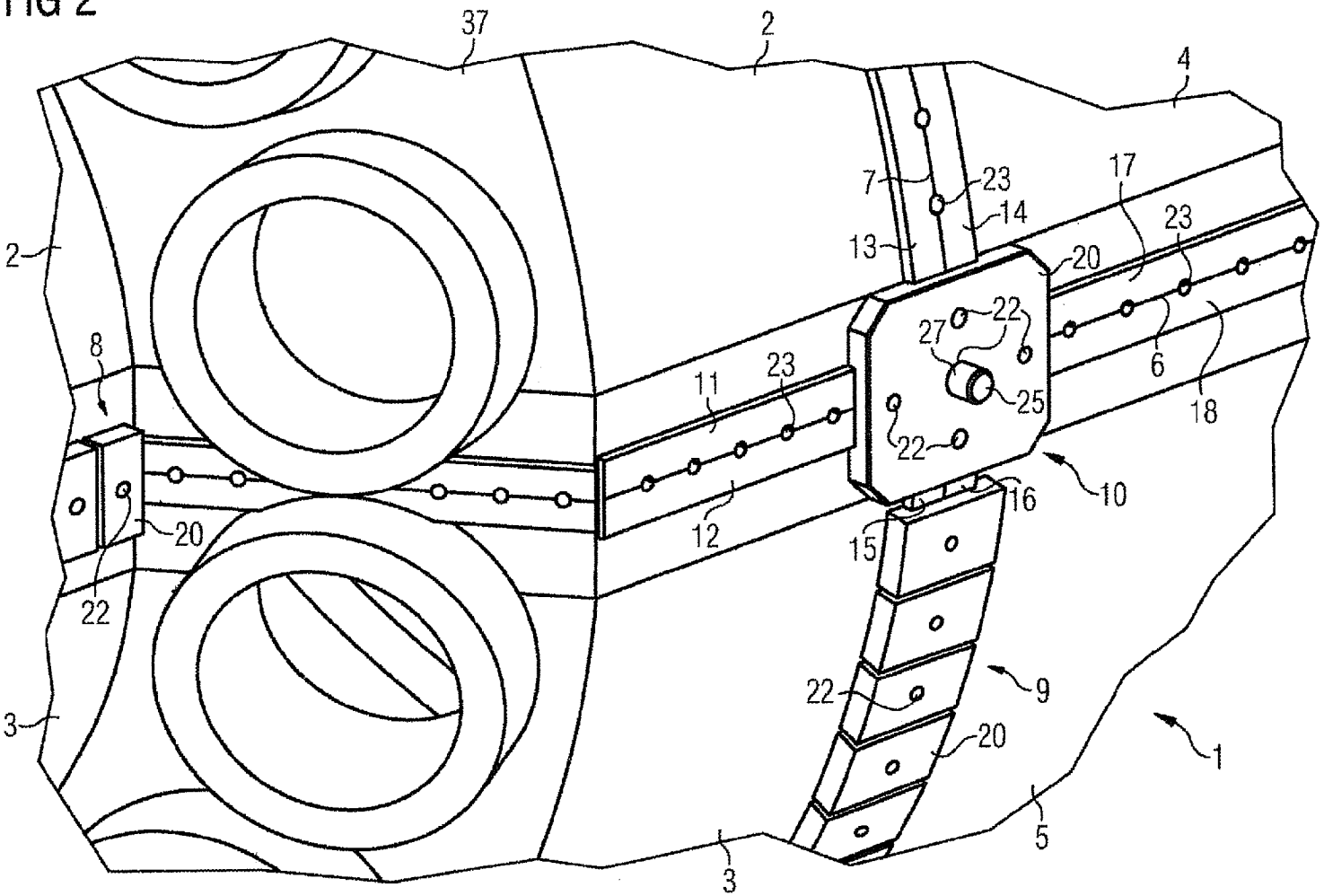
FIGS. 2-7 show a perspective view of the turbomachine casing in the region of the horizontal parting joint, of a vertical parting joint, and in the region of the parting joint intersection.
Figure 3:
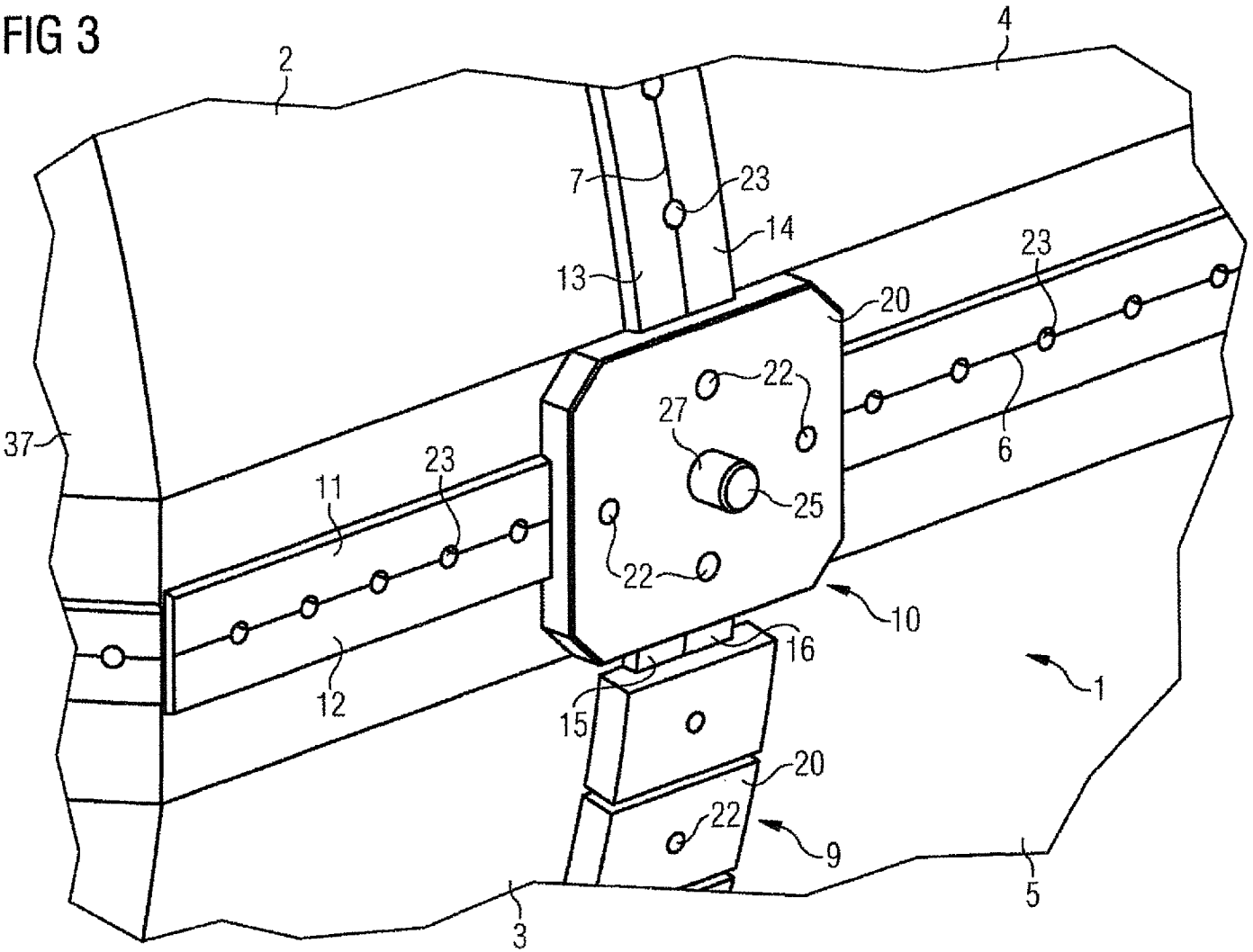
Figure 4:
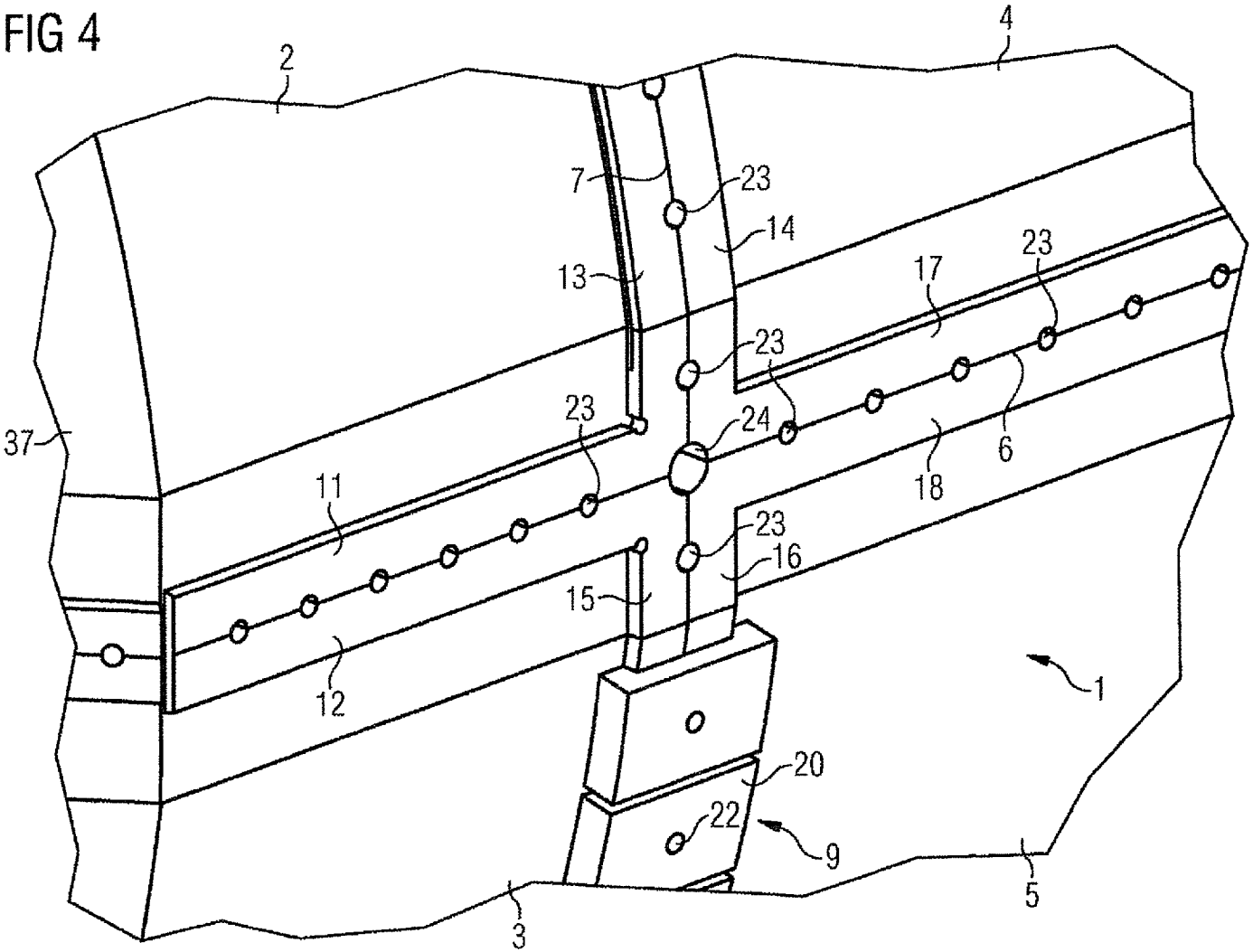
Figure 5:
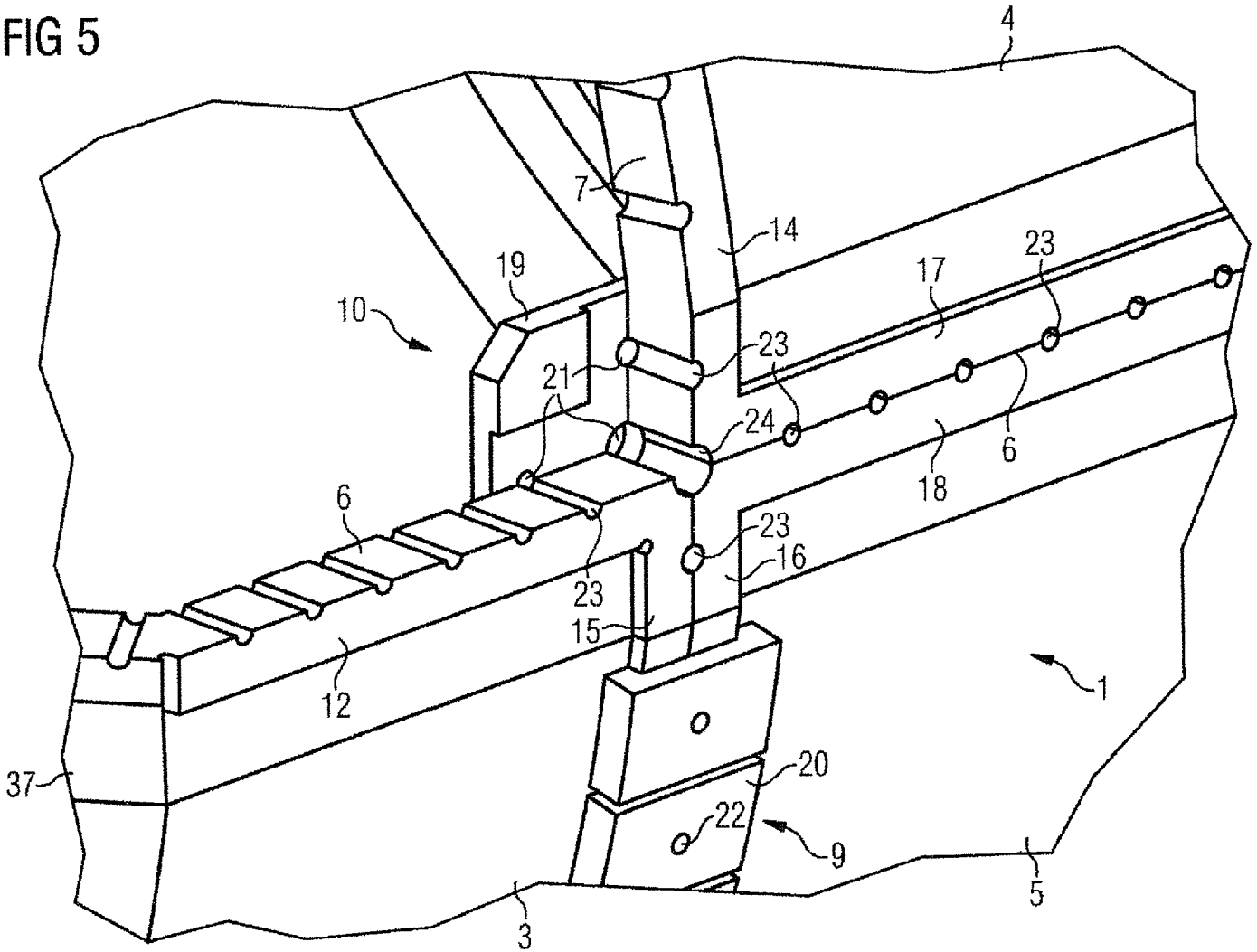
Figure 6:
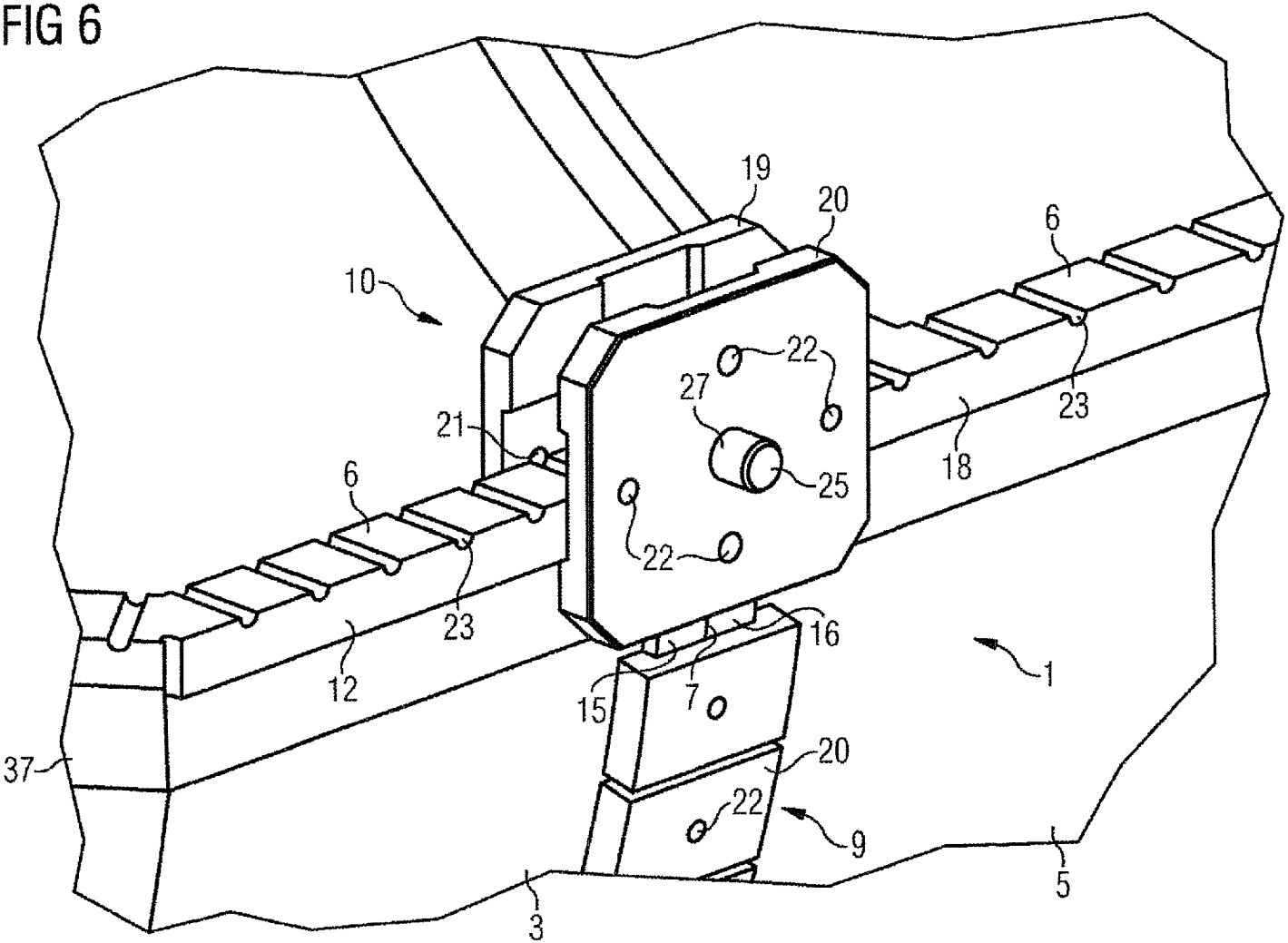
Figure 7:
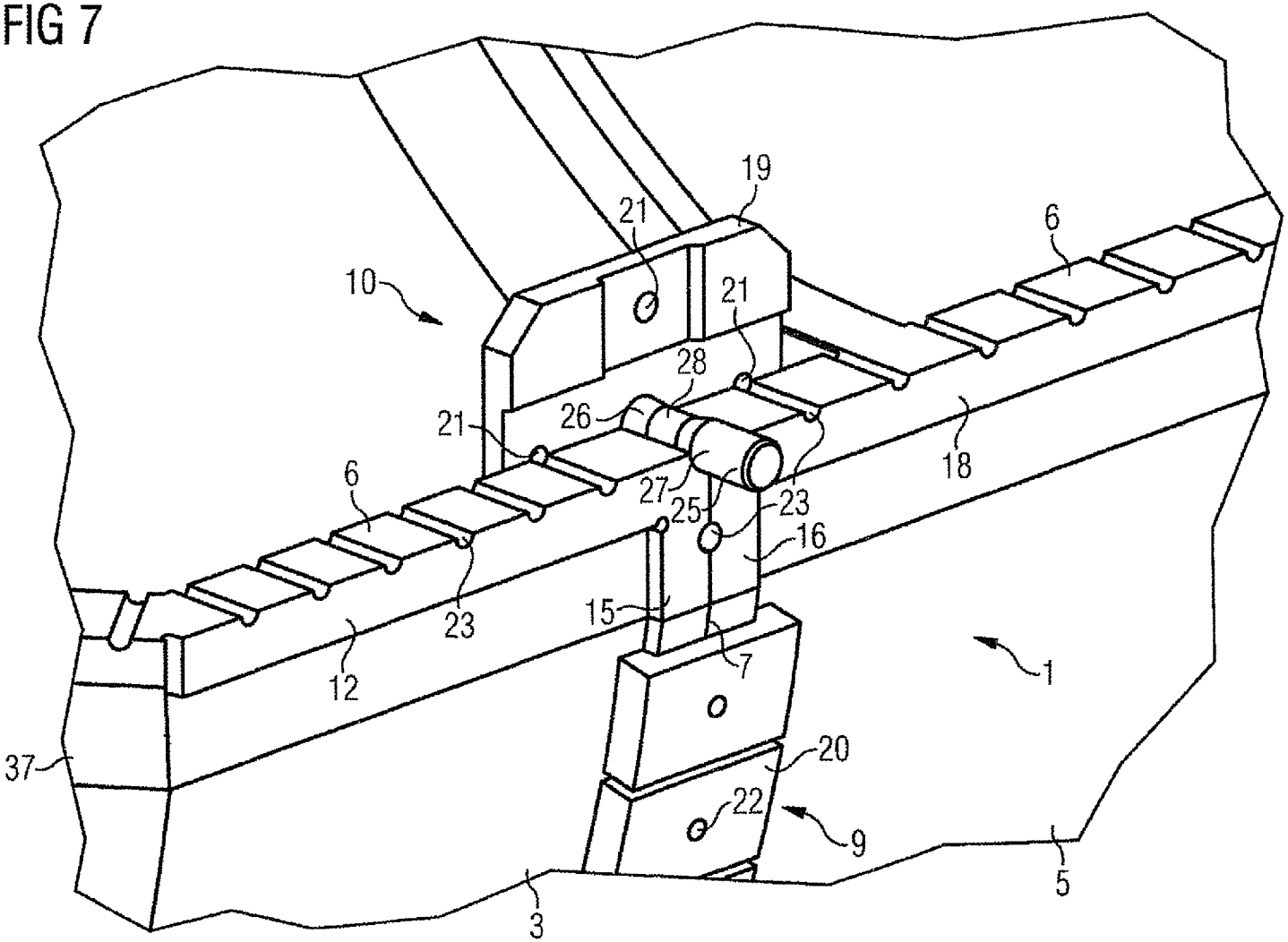
Figure 8:
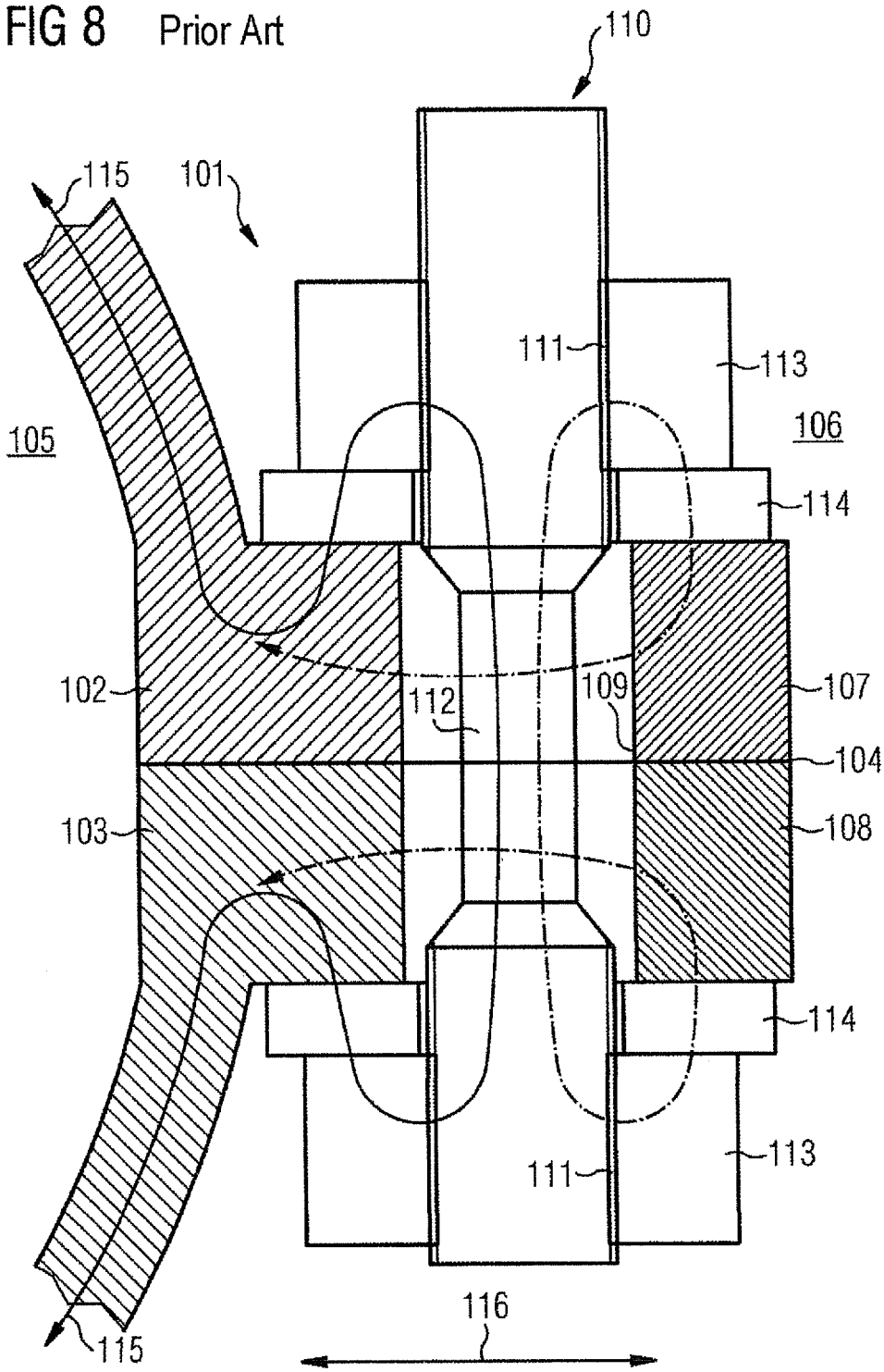
FIG 8 Prior Art
FIG. 8 shows a cross section through a conventional turbomachine casing in the region of a parting joint.

As is apparent from FIGS. 1 to 7, a turbomachine casing 1 has a first casing section 2, a second casing section 3, a third casing section 4 and a fourth casing section 5. The first casing section 2 and the third casing section 4, as seen in FIGS. 2 to 5, form the top casing half of the turbomachine casing 1, and the second casing section 3 and the fourth casing section 5, as seen in FIGS. 2 to 5, faun the bottom casing half of the turbomachine casing 1, wherein the first casing section 2 and the second casing section 3, together with the third casing section 4 and the fourth casing section 5, form a horizontal parting joint 7. In addition, the turbomachine casing 1 has a vertical parting joint 6 which is formed by the first casing section 2 and the third casing section 4 together with the second casing section 3 and the fourth casing section 5. The vertical parting joint 6 and the horizontal parting joint 7 intersect. Moreover, the turbomachine casing 1 has a casing step 37 in the first casing section 2 and in the second casing section 3, which is divided by the vertical parting joint 6.

The vertical parting joint 6 is held together by a multiplicity of vertical parting-joint clamps 8 and the horizontal parting joint 7 is held together by a multiplicity of horizontal parting joint-clamps 9. The vertical parting-joint clamps 8 are arranged next to each other in a row along the vertical parting joint 6 and the horizontal parting-joint clamps 9 are arranged next to each other in a row along the horizontal parting joint 7. In the region of intersection of the vertical parting joint 6 and the horizontal parting joint 7 provision is made for an intersection parting-joint clamp 10.

The first casing section 2 has first parting-joint protuberance 11 at the vertical parting joint 6 and in the region of the horizontal parting joint 7 has a third parting-joint protuberance 13. In a similar way, on the second casing section 3 a second parting-joint protuberance 12 is foimed at the vertical parting joint 6 and a fifth parting-joint protuberance 15 is fomied at the horizontal parting joint 7. In the same way, the third casing section 4 and the fourth casing section 5 are provided with parting-joint protuberances, wherein the third casing section 4 has a fourth parting-joint protuberance 14 at the horizontal parting joint 7 and has a seventh parting joint protuberance 17 at the horizontal parting joint 7, and the fourth casing section 5 has an eighth parting-joint protuberance 18 at the vertical parting joint 6 and a sixth parting joint protuberance 16 at the horizontal parting joint 7. Each parting-joint protuberance 11 to 18 in this case comprises a section which projects from the external surface of the corresponding casing section and a section which projects from the internal surface.

The parting-joint clamps 8, 9, 10 have an inner part 19 and an outer part 20 in each case, wherein the inner part, in a form-fitting manner, encompasses the section of the parting joint protuberances which lie inside the turbomachine casing 1 and the outer part 20, in a form-fitting manner, encompasses the sections of the parting-joint protuberances which lie outside the turbomachine casing 1. For each parting-joint clamp 8, 9, 10, each parting joint 6, 7 has a parting-joint hole 23 which is provided centrally at the parting joint 6, 7. Aligning with the parting joint hole 23, a threaded hole 21 is provided in the inner part 19, facing the turbomachine casing 1. In addition, an insertion hole 22 is provided in the outer part 20, aligning with the threaded hole 21 and with the parting joint hole 23.

At the point of intersection of the horizontal parting joint 7 and the vertical parting joint 6, provision is additionally made in the turbomachine casing 1 for an intersection hole 24, the longitudinal axis of which lies at the point of intersection of the horizontal parting joint 7 and the vertical parting joint 6. In a similar way, as for the parting joint hole 23, for the intersection hole 24 a threaded hole 21 is provided in the inner part 19 of the intersection parting-joint clamps 10 and an insertion hole 22 is provided in the outer part 20 of the intersection parting-joint clamps 10, wherein the threaded hole 21, the insertion hole 22 and intersection hole 24 are in alignment with each other.

A retaining screw 25 is inserted through the insertion hole 22, the parting-joint hole 23 or the intersection hole 24, and into the threaded hole 21. The retaining screw 25 has a first threaded section 26 and a second threaded section 27, wherein a waisted shank 28 can be provided between the first threaded section 26 and the second threaded section 27. The retaining screw 25 is inserted into the holes 21 to 23 in such a way that the first threaded section 26 engages in the threaded hole 21, forming a threaded connection, the second threaded section 27 projects from the outer part 20 outwards from the turbomachine casing 1, and the waisted shank 28 is arranged between the parting joint protuberances 11 to 18. A threaded nut 29, with a washer 30, is screwed onto the second threaded section 27 so that when tightening down the threaded nut 29 the inner part 19 and the outer part 20 are pressed by the threaded nut 29 onto the parting-joint protuberances 11 to 18. Naturally, two or more retaining screws 25 per parting joint clamp may also be provided, which if necessary can even be arranged off-center, i.e. even outside the parting joint.

The turbomachine casing 1 is formed with a T-shaped cross section at the parting-joint protuberances 11 to 18, wherein the parting-joint protuberances 11 to 18 have protuberance flanks 31 on their sides which face away from the parting-joint holes 23. The inner protuberance flanks are formed essentially parallel to the longitudinal axis of the parting-joint hole 23, wherein the protuberance flanks 31 are arranged in a maimer in which they are inclined away from the turbomachine casing 1, sloping down towards the parting joint hole 23.

The inner part 19 and the outer part 20 are of a C-shaped design and encompass the parting joint protuberances 11 to 18 by their protuberance flanks 31. Interacting with the protuberance flanks 31, the inner part 19 and the outer part 20 have clamp flanks 32 in each case, which are formed parallel to the protuberance flanks 31.

When assembling the turbomachine casing 1 with its casing sections 2 to 5, the procedure is as follows: First of all, the inner part 19 is located on the inner section of the parting joint protuberances 11 to 18 so that the inner part 19 by its clamp flanks 32 butts against the protuberance flanks 31. Next, the retaining screw 25 is to be inserted through the parting joint hole 23 or the intersection hole 24 and is to be screwed up tight in the threaded hole 21 with the first threaded section 26 on the inner part 19. As the next step, the outer part 20 with the insertion hole 22 is to be fitted onto the second threaded section 27 of the retaining screw 23 so that the outer part 20 by its clamp flanks 32 butts against the protuberance flanks 31 of the outer sections of the parting-joint protuberances 11 to 18 and a region of the second threaded section 27 projects from the outer part 20. The threaded nut 29, together with the washer 30, is then to be screwed onto the second threaded section 27. The threaded nut 29 is to be tightened down to the extent that the inner part 19 and the outer part 20 are thereby pressed against the parting-joint protuberances 11 to 18, wherein as a result of the protuberance flanks 31 and the clamp flanks 32 sliding upon each other, brought about as a result of inclined arrangement of the flanks 31, 32 with regard to the longitudinal axis of the retaining screw 25, the casing sections 2 to 5 are pressed together at the parting joints 6, 7.

As a result, it is possible for a high tensioning force 35 to act on the turbomachine casing 1 at the parting joints 6, 7 without a gap occurring at the parting joints 6, 7. Furthermore, the vertical parting joint 6 for example is retained in a form-fitting manner in the horizontal direction 36 at the vertical parting joint 6.

The force flux 34, which is formed in the region of the parting joints 6, 7 of the turbomachine casing 1, is formed symmetrically so that in the region of the parting joints 6, 7 the turbomachine casing 1 and the retaining screws 25 are not flexurally stressed.

Furthermore, a seal 33 is provided between the inner part 19 and the inner section of the parting joint protuberances 11 to 18, as a result of which the inside of the turbomachine casing 1 is outwardly sealed off in a gastight manner.

The invention claimed is:

1. A turbomachine casing with a parting joint, comprising:
a first casing section with a first parting-joint protuberance which is formed at the parting joint;
a second casing section with a second parting-joint protuberance which is formed at the parting joint; and
a plurality of parting-joint clamps,
wherein the first parting-joint protuberance together with the second parting-joint protuberance are encompassed by the parting-joint clamps,
wherein the first and the second casing sections are held together by the parting-joint clamps via a form-fitting connection on the parting-joint protuberances,
wherein each parting-joint protuberance extends both inside and outside the turbomachine casing and each parting-joint clamp has an inner part and an outer part, and
wherein the inner part acts on inner sections of the parting-joint protuberances and the outer part acts on outer sections of the parting-joint protuberances.

2. The turbomachine casing as claimed in claim 1, wherein each parting-joint clamp has a single inner part and a single outer part.

3. The turbomachine casing as claimed in claim 1, wherein each parting-joint clamp has a single inner part and a plurality of outer parts.

4. The turbomachine casing as claimed in claim 1, wherein each parting-joint clamp has a plurality of inner parts and a single outer part.

5. The turbomachine casing as claimed in claim 1,
wherein at each position of the parting-joint, at which one of the parting-joint clamps is arranged, the turbomachine casing comprises a parting-joint hole and the parting-joint clamp comprises a retaining unit which extends through the parting-joint hole and is fastened both to the inner part and to the outer part, and
wherein the inner part and the outer part are held against the parting-joint protuberances by the retaining unit, and
wherein the inner part, the outer part and the retaining unit interact in a form-fitting manner such that casing sections are pressed together at the parting-joint by the parting-joint clamps.

6. The turbomachine casing as claimed in claim 5, wherein the retaining unit includes a retaining screw which is inserted through the parting-joint hole and foinis together with the inner part a threaded connection.

7. The turbomachine casing as claimed in claim 6,
wherein the retaining unit includes a threaded nut,
wherein the retaining screw is screwed into a threaded hole of the inner part and is inserted through an insertion hole of the outer part and is also tightened up by the threaded nut from outside the turbomachine casing.

8. The turbomachine casing as claimed in claim 7, wherein a washer is arranged between the threaded nut and the outer part.

9. The turbomachine casing as claimed in claim 1,
wherein protuberance flanks are provided on the inner and outer sections of the parting-joint protuberances,
wherein the inner part has clamp flanks which interact with inner protuberance flanks and the outer part has clamp flanks which interact with outer protuberance flanks, and wherein the protuberance flanks and the clamp flanks are arranged in an inclined manner such that during clamping of the inner part and of the outer part the parting-joint protuberances are pressed together by the parting-joint clamps.

10. The turbomachine casing as claimed in claim 9, wherein the retaining unit includes a retaining screw which is inserted through the parting-joint hole and forms together with the inner part a threaded connection.

11. The turbomachine casing as claimed in claim 10, wherein the retaining unit includes a threaded nut, wherein the retaining screw is screwed into a threaded hole of the inner part and is inserted through an insertion hole of the outer part and is also tightened up by the threaded nut from outside the turbomachine casing.

12. The turbomachine casing as claimed in claim 11, wherein a washer is arranged between the threaded nut. and the outer part.

13. The turbomachine casing as claimed in claim 1, wherein a seal is arranged between the inner part and the inner sections of the parting-joint protuberances so that an inside of the turbomachine casing is outwardly sealed off in a gastight manner.

14. The turbomachine casing as claimed in claim 1, wherein the parting-joint is a vertical parting-joint and the parting-joint clamp holds together the vertical parting-joint.

15. The turbomachine casing as claimed in claim 14, wherein the vertical parting-joint and a horizontal parting-joint intersect and an intersection parting-joint clamp is arranged at a point of intersection, the intersection parting-joint clamp being formed by two parting-joint clamps provided for the vertical parting-joint and arranged in an oppositely disposed manner at the point of intersection, and two parting-joint clamps provided for the horizontal parting-joint and arranged in an oppositely disposed manner at the point of intersection.

16. The turbomachine casing as claimed in claim 15, wherein an additional retaining unit is provided at the point of intersection for holding together the inner part and the outer part.

17. The turbomachine casing as claimed in claim 1, wherein the parting-joint is a horizontal parting-joint and the parting-joint clamp holds together the horizontal parting-joint.

18. The turbomachine casing as claimed in claim 17, wherein a vertical parting-joint and the horizontal parting-joint intersect and an intersection parting-joint clamp is arranged at a point of intersection, the intersection parting-joint clamp being formed by two parting-joint clamps provided for the vertical parting-joint and arranged in an oppositely disposed manner at the point of intersection, and two parting-joint clamps provided for the horizontal parting-joint and arranged in an oppositely disposed manner at the point of intersection.

19. The turbomachine casing as claimed in claim 18, wherein an additional retaining unit is provided at the point of intersection for holding together the inner part and the outer part.

* * * * *